US008540100B1

(12) United States Patent
Lee

(10) Patent No.: US 8,540,100 B1
(45) Date of Patent: Sep. 24, 2013

(54) CAP FOR TRAVEL TOOTHPASTE TUBE WITH INTEGRATED REFILL ADAPTER

(71) Applicant: Eun Jin Grace Lee, Seoul (KR)

(72) Inventor: Eun Jin Grace Lee, Seoul (KR)

( * ) Notice: Subject to any disclaimer, the term of this patent is extended or adjusted under 35 U.S.C. 154(b) by 0 days.

(21) Appl. No.: 13/746,684

(22) Filed: Jan. 22, 2013

(30) Foreign Application Priority Data

Apr. 13, 2012 (KR) ..... 10-2012-0038429

(51) Int. Cl.
*B65D 41/56* (2006.01)

(52) U.S. Cl.
USPC ..... 220/212; 141/319

(58) Field of Classification Search
USPC ..... 220/212, 254.2, 254.3; 141/114, 141/319; 401/269, 277, 175
See application file for complete search history.

(56) References Cited

U.S. PATENT DOCUMENTS

| | | | | |
|---|---|---|---|---|
| 3,261,381 | A * | 7/1966 | Roach | 141/114 |
| 4,386,696 | A * | 6/1983 | Goncalves | 206/221 |
| 5,000,236 | A * | 3/1991 | Jemison | 141/319 |
| 5,595,314 | A * | 1/1997 | Weiler | 215/50 |
| 5,918,650 | A * | 7/1999 | Borden | 141/383 |
| 6,655,524 | B2 * | 12/2003 | De Laforcade | 206/222 |
| 6,659,145 | B1 * | 12/2003 | Reif et al. | 141/319 |
| 7,210,508 | B2 * | 5/2007 | Behar | 141/329 |
| 2008/0230544 | A1 * | 9/2008 | Kim | 220/254.7 |

FOREIGN PATENT DOCUMENTS

| | | |
|---|---|---|
| KR | 83-3945 | 12/1983 |
| KR | 20-0325110 | 9/2003 |
| KR | 20-0412106 | 3/2006 |
| KR | 10-2009-0056571 | 6/2009 |
| KR | 10-2011-0067284 | 6/2011 |

* cited by examiner

*Primary Examiner* — J. Gregory Pickett
*Assistant Examiner* — Ernesto Grano
(74) *Attorney, Agent, or Firm* — NSIP Law

(57) ABSTRACT

A refill adapter for a travel toothpaste tube is provided as an adapter which has one end to be engaged with a large-capacity toothpaste tube and the other end to be engaged with a travel toothpaste tube. The refill equipment is integrated with a cap for the travel toothpaste in order to be carried together with the cap as one body. The cap for the travel toothpaste tube includes a refill adapter, which is configured to be a hollow tube and have one end to be engaged with a nozzle of a large-capacity toothpaste tube and the other end to be engaged with a nozzle of the travel toothpaste tube, and an upper cap configured to be detachably engaged with the one end of the refill adapter.

3 Claims, 6 Drawing Sheets

CAP FOR TRAVEL TOOTHPASTE TUBE WITH INTEGRATED REFILL ADAPTER

CROSS-REFERENCE TO RELATED APPLICATION

This application claims the benefit under 35 U.S.C. §119 (a) of Korean Patent Application No. 10-2012-0038429, filed on Apr. 13, 2012, the entire disclosure of which is incorporated herein by reference for all purposes.

BACKGROUND

1. Field

The following invention relates to a toothpaste tube, and, more particularly, a technique for refilling a travel toothpaste tube.

2. Description of the Related Art

A travel toothpaste tube of the related art is disposable and unable to be refilled. Since the travel toothpaste tube is generally made of a plastic or aluminum material, it is desired that the tube is collected for reuse. However, it is often abandoned carelessly, leading to an environmental pollution.

Korean Patent Laid-Open Publication No. 2009-0056571 discloses a toothpaste refill-container as shown in FIG. 1. FIG. 1 is a schematic diagram illustrating the toothpaste refill-container of the related art. Referring to FIG. 1, toothpaste is refilled by opening a vessel cover 20 of the toothpaste refill-container. In addition, a guide unit 12, that is, an inner partition, of the toothpaste refill-container allows internal air to be discharged so as to refill toothpaste easily. However, since the toothpaste refill-container of the related art is realized as a large hard case, it is inconvenient to carry and uncomfortable to refill with toothpaste.

In addition, Korean Patent Laid-Open Publication No. 10-2011-0067284, filed on Dec. 14, 2009, and published on Jun. 22, 2011, discloses a nipple which can be used for refilling a small-sized toothpaste tube with toothpaste from a large-capacity toothpaste tube. The nipple has one end having a stopper to be engaged with the large-capacity toothpaste tube and the other end having screw grooves to be engaged with a small-sized toothpaste tube. However, since this nipple cannot be kept as combined with a toothpaste tube, the chance is high that the nipple disappears and cannot be found, particularly due to its small size.

SUMMARY

The following description aims to provide a refill equipment which makes it easy to refill a travel toothpaste tube.

Furthermore, the following description is designed to provide a handy small-sized refill equipment.

In one general aspect of the present invention, the refill equipment is provided as a refill adapter having one end to be engaged with a large-capacity toothpaste tube and the other engaged with a travel toothpaste tube. The refill equipment is integrated with a cap for the travel toothpaste tube to be carried with the cap as one body.

Other features and aspects will be apparent from the following detailed description, the drawings, and the claims.

Figure 1:
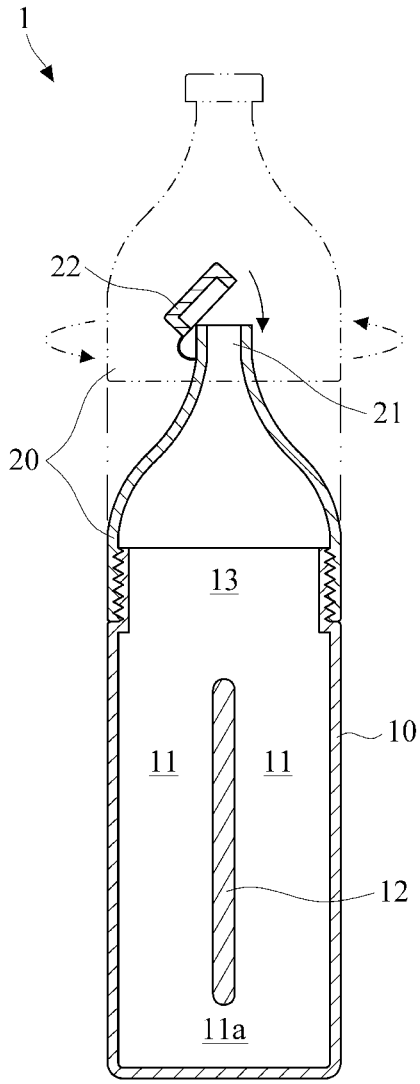
FIG. 1 PRIOR ART
FIG. 1 is a diagram illustrating a refill container of the related art.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will suggest themselves to those of ordinary skill in the art. Also, descriptions of well-known functions and constructions may be omitted for increased clarity and conciseness.

Figure 2:
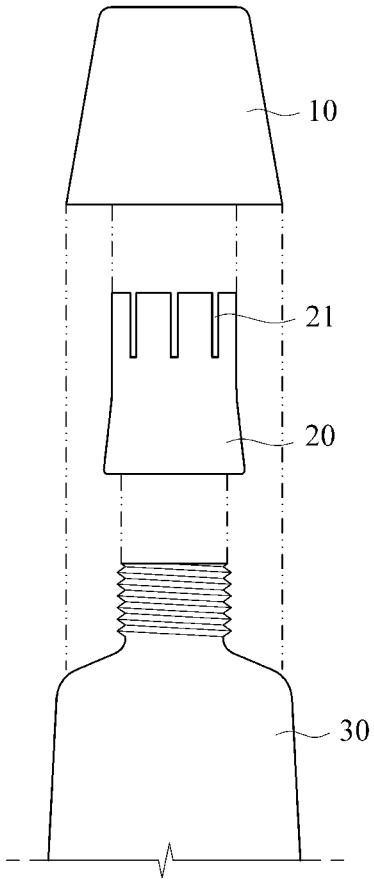
FIG. 2 is a diagram illustrating appearance of a cap 10 and 20 for a travel toothpaste tube according to an exemplary embodiment of the present invention.

FIG. 2 is a diagram illustrating appearance of a cap 10 and 20 of a travel toothpaste tube according to an exemplary embodiment of the present invention. As shown in FIG. 2, the cap for a travel toothpaste tube includes a refill adapter 20 and an upper cap 10. The refill adapter 20 is configured to be a hollow tube and have one end to be engaged with a nozzle of a large-capacity toothpaste tube and the other end to be engaged with a nozzle of a travel toothpaste tube. In addition, the upper cap 10 is configured to be detachably engaged with the refill adapter 20.

A plurality of slits 21 are formed in the upper part of the refill adapter 20. Gaps between the slits 21 are widened, helping the refill adapter 20 to be easily engaged with the nozzle of the large-capacity toothpaste tube and making the cap 10 detachable easily from the refill adapter 20. The refill adapter 20 may be configured in various ways so long as one end of the refill adapter 20 is capable of being engaged with a nozzle of a large refill toothpaste tube and the other end is capable of being engaged with a nozzle of a refillable travel toothpaste tube.

The upper cap 10 is engaged with the upper part of the refill adapter 20. In addition, when being engaged with the refill adapter 20, the engaged cap 10 is used as a cap for the travel toothpaste tube 30. In addition, a screw groove may be formed in the lower part of the refill adapter 20 for engagement with the travel toothpaste tube.

Two functional features have to be considered to manufacture a cap for a toothpaste tube. The first feature is ability to prevent toothpaste leakage, and the second one is convenience of opening and closing. The second feature is regarded more important for a regular toothpaste tube, since it is easy to handle and keep a toothpaste tube at home. On the other hand, the first feature is thought more important for a travel toothpaste tube because toothpaste may leak due to pressure in a travel bag. For this reason, a cap for the regular toothpaste tube is engaged with the body of the toothpaste tube using a snap-fastening type structure, while a cap for the travel toothpaste tube is engaged with a corresponding body using a screw-fastening type structure.

Figure 3:
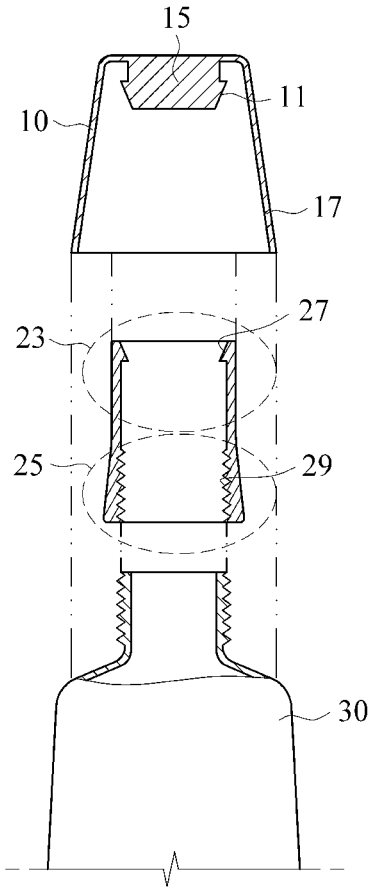
FIG. 3 is a cross-sectional view illustrating a configuration of the cap for a travel toothpaste tube shown in FIG. 2.

FIG. 3 is a cross-sectional view illustrating a configuration of a cap for a travel toothpaste tube shown in FIG. 2. As illustrated in FIG. 3, the refill adapter 20 for the cap for the travel toothpaste tube may include a first engagement part 23 and a second engagement part 25. The first engagement part is engaged with a nozzle of a large-capacity toothpaste tube using a snap-fastening type structure, and the second engagement part 25 is engaged with the travel toothpaste tube using a screw-fastening type structure. However, the above are merely exemplary, and the refill adapter 20 of the present invention may be realized in various ways so long as one end of the refill adapter 20 is engaged with a nozzle of a large refill toothpaste tube and the other end is engaged with a nozzle of a refillable travel toothpaste tube. In addition, the refill adapter 20 is a hollow tube.

Similar to FIG. 2, a plurality of silts are formed in the upper part of the first engagement part 23 in FIG. 3. In addition, a stopper 27 is formed on the end of each slit along a circumference of the refill adapter 20. Even in the case where the stoppers 27 are formed on the end of some of the slits, rather than all of the slits, along the circumference, the refill adapter 20 is able to be engaged with the upper cap 10. When the refill adapter 20 is engaged with the upper cap 10, each of the stoppers 27 of the refill adapter 20 is engaged with a stopper 11 of the upper cap 10, so that the upper cap 10 may not be detached easily from the refill adapter 20.

The upper cap 10 may include a cylindrical-shaped snap fit 15 and a handle part 17. The snap fit 15 includes the stopper 11, which is formed along a circumference of the snap fit 15 and snapped onto the first engagement part 23 of the refill adapter 20 using a snap-fastening type structure. In addition, the handle part 17 is extended downward in a skirt shape from a top of the snap fit 15, and covers at least a part of an outer circumference of the one end of the refill adapter 20 when the cap 20 is engaged with the first engagement part 23. When the upper cap 10 is engaged with the refill adapter 20, the snap fit 15 is fitted to the first engagement part 23 of the refill adapter 20 so as to prevent toothpaste leakage. Meanwhile, the stopper 11 of the snap fit 15 is formed along a circumference of the snap fit 15 to have the same size and shape as a nozzle of a regular toothpaste tube. Accordingly, the stopper 11 configured as above helps the upper cap 10 not to be easily detached from the refill adapter 20. In addition, the skirt-shaped handle part 17 helps the travel toothpaste tube having an integrated refill adapter 20 to look seamless. In addition, concavo-convex patterns are formed on the outer surface of the skirt-shaped upper cap 10, enabling a user to detach the upper cap 10 from the refill adapter 20 without slipperiness.

Figure 4:
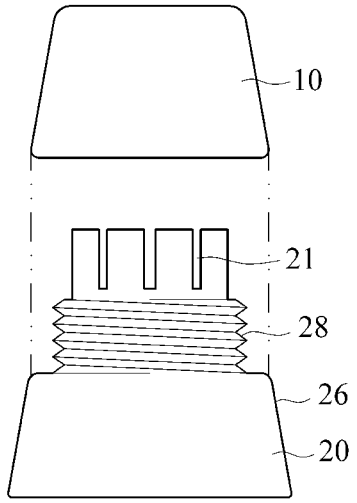
FIG. 4 is a diagram illustrating appearance of a cap for a travel toothpaste tube according to another exemplary embodiment of the present invention.
Figure 5:
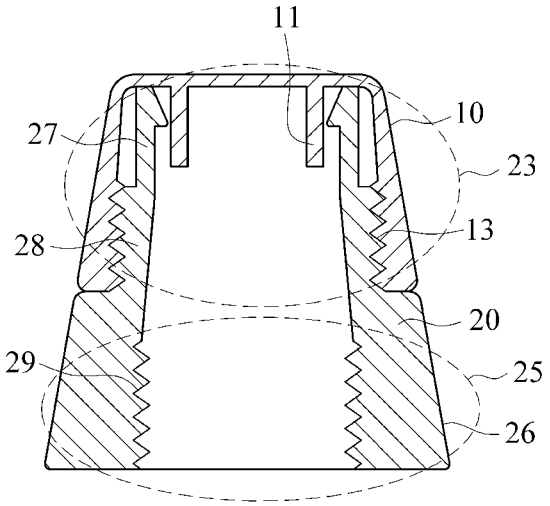
FIG. 5 is a cross-sectional view illustrating a configuration of the cap for a travel toothpaste tube shown in FIG. 4.

FIG. 4 is a diagram illustrating appearance of a cap for a travel toothpaste tube according to another exemplary embodiment of the present invention, and FIG. 5 is a cross-sectional view illustrating a configuration of the cap for the travel toothpaste tube shown in FIG. 4. The cap for a travel toothpaste tube according to another exemplary embodiment of the present invention is provided with references to FIGS. 4 and 5.

As illustrated in FIGS. 4 and 5, the cap for a travel toothpaste tube includes a refill adapter 20 and an upper cap 10. The refill adapter 20 is configured to be a hollow tube and have one end to be engaged with a nozzle of a large-capacity toothpaste tube and the other end to be engaged with a nozzle of a travel toothpaste tube. The upper cap 10 is configured to be detachably engaged with one end of the refill adapter 20.

A plurality of slits 21 are formed in the upper part of the refill adapter 20. When the refill adapter 20 is engaged with the nozzle of the large-capacity toothpaste tube, gaps between the slits 21 are widened, helping the refill adapter 20 to be easily engaged with the nozzle of the large-capacity toothpaste tube and making the cap 10 detachable easily from the refill adapter 20. The refill adapter 20 may be configured in various ways so long as one end of the refill adapter 20 is engaged with a nozzle of a large refill toothpaste tube and the other end is engaged with a nozzle of a refillable travel toothpaste tube.

The upper cap 10 is engaged with the upper part of the refill adapter 20. With engaged with the refill adapter 20, the upper cap 10 is able to be used as a cap for a travel toothpaste tube 30. In addition, a screw groove may be formed in an inner surface of the lower part of the refill adapter 20 for engagement with the travel toothpaste tube 30.

Similarly to the exemplary embodiments shown in FIGS. 2 and 3, the refill adapter 20 of FIGS. 4 and 5 may include a first engagement part 23 and a second engagement part 25. The first engagement part 23 may be formed at one end of the refill adapter 20 to be engaged with a nozzle of a large-capacity toothpaste tube using a snap-fastening type structure. The second engagement part 25 may be formed at the other end of the refill adapter 20 and engaged with a nozzle of a travel toothpaste tube using a screw-fastening type structure. However, the above is merely exemplary, and the refill adapter 20 of the present invention may be configured in various ways so long as one end of the refill adapter 20 is engaged with a nozzle of a large refill toothpaste tube and the other end is engaged with a nozzle of a refillable travel toothpaste tube. In addition, the refill adapter 20 is a hollow tube.

Referring to FIG. 4, a plurality of slits 21 are formed in the upper part of the first engagement part 23. In addition, stoppers 27 are formed in the end of each slit 21 along a circumference of the refill adapter 20. Although the stoppers 27 are formed in the ends of some of the slits 21, rather than all of the slits 21, along a circumference of the refill adapter 20, there is no problem for engagement with the upper cap 10.

Referring to FIG. 4, a screw thread 28 may be formed on an outer circumferential surface of one end of the refill adapter 20, and the screw groove may be formed on an inner circumferential surface of the other end of the refill adapter 20. In this way, the upper cap 10 is engaged with the refill adapter 20 using a screw-fastening type structure so as to prevent toothpaste leakage when toothpaste is refilled via the refill adapter 20. In addition, the upper part of the refill adapter 20 is thinner than the lower part, and a plurality of slits 21 are formed in the upper part. Due to this configuration, the upper part of the refill adapter 20 may be elastically engaged with a nozzle of a large regular toothpaste tube. In addition, a screw thread is formed on an outer surface of the lower part of the refill adapter 20, rather than an outer surface of the upper part.

When the upper cap 10 is engaged with the upper part of the refill adapter 20, the outer surface of the upper cap 10 appears to be seamlessly connected to the exposed outer surface of the refill adapter 20. Due to this configuration, a cap for the travel toothpaste tube looks seamless even though the cap is a combination of the upper cap 10 and the refill adapter 20. In addition, concavo-convex patterns are formed on the exposed outer surface of the refill adapter 20, while concavo-convex patterns may not be formed on the outer surface of the upper cap 10, so that it may not be easy to detach the upper cap 10 from the refill adapter 20.

Figure 6:
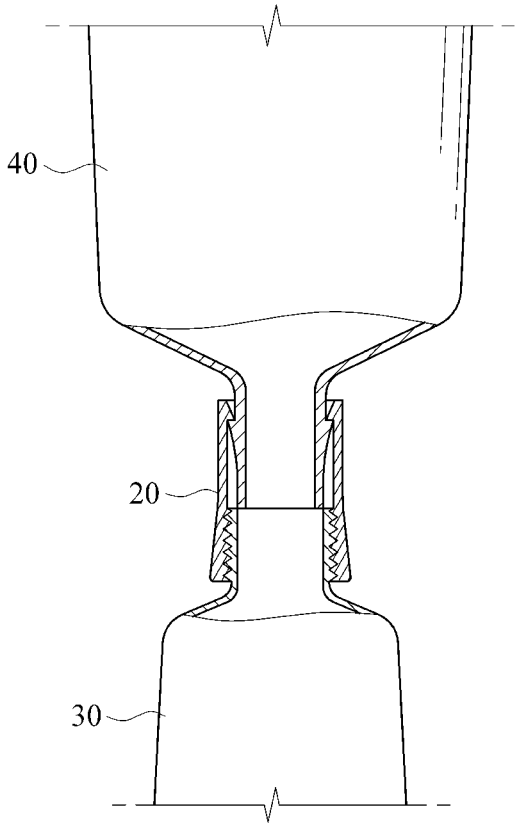
FIG. 6 is a diagram illustrating a method for refilling a travel toothpaste tube using a refill adapter 20 separated from an upper cap 10.

FIG. 6 is a diagram illustrating a method for refilling a travel toothpaste tube using a refill adapter 20 separated from an upper cap 10. A first engagement part of the refill adapter 20 is engaged with a nozzle of a regular toothpaste using a snap-fastening type structure. In addition, a second engagement part of the refill adapter 20 is engaged with a nozzle of a travel toothpaste tube using a screw-fastening type structure. If a user presses the regular toothpaste tube engaged with the refill adapter 20, contents of the regular toothpaste tube will transfer, refilling the travel toothpaste tube. At this time, a used travel toothpaste tube has two internal surfaces touching each other with almost no volume of air as it is empty.

According to an exemplary embodiment of the present invention, it is able to easily refill a travel toothpaste tube from a large regular toothpaste tube using a refill adapter. At home, the refill adapter may be kept separately and used by being fitted to a toothpaste tube. Meanwhile, during travel, it is also possible to use the refill adapter as a cap for a toothpaste tube by engaging an upper cap thereto. Thus, there is no need to carry the refill adapter separately, and thus, a user may be able to refill an empty travel toothpaste tube anytime anywhere during travel.

A cap configured such that a refill adapter is engaged with an upper cap may be applied to almost every travel toothpaste tube since the travel toothpaste tubes are all manufactured to have the same size. Thus, there may be demand or customers for only the cap, rather than the whole travel toothpaste tube.

A conventional travel toothpaste tube is made of plastic or aluminum materials. When running out of contents, the travel toothpaste tube is abandoned in many cases, instead of being collected for recycle, thereby worsening the environmental pollution. In this regard, a refillable toothpaste tube brings environmental benefits as well as saving natural resources.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A cap for a travel toothpaste tube, the cap comprising:

a refill adapter, having a hollow tube shape, comprising a first end having a first screw groove formed on an outer circumference thereof and a snap-fastening structure with a plurality of slits for enabling a nozzle of a large-capacity toothpaste tube to be engaged with the snap-fastening structure, and a second end having a screw-fastening structure for enabling a nozzle of a travel toothpaste tube to be engaged with the screw fastening structure, thus allowing the travel toothpaste tube to be refilled with toothpaste from the large-capacity toothpaste tube; and an upper cap comprising a cylindrical-shaped snap-fit that protrudes downwardly from an inner surface of the upper cap, a handle extending downwardly in a skirt shape from a top of the cylindrical-shaped snap fit, and a second screw groove formed on an inner circumference of the upper cap, wherein the cylindrical-shaped snap fit is enclosed within the handle of the upper cap;

the handle of the upper cap is configured to cover the first end of the refill adapter in order to provide a seamless appearance in response to the upper cap being engaged with the refill adapter;

the plurality of slits of the snap-fastening structure are flexible and have a plurality of gaps therebetween which widen in response to the refill adapter being engaged with the large-capacity toothpaste tube;

the first screw groove of the refill adapter is configured to engage with the second screw groove of the upper cap for securing the refill adapter to the upper cap; and each of the plurality of slits has one of a plurality of teeth configured to snap onto the cylindrical-shaped snap fit to secure the refill adapter to the upper cap, or to snap onto a protruding boundary on the nozzle of the large-capacity toothpaste tube to secure the refill adapter to the large-capacity toothpaste tube.

2. The cap of claim 1, wherein the upper cap is engaged with an upper part of the refill adapter, making an exposed outer surface of the refill adapter and an outer surface of the upper cap look connected seamlessly.

3. The cap of claim 2, wherein the refill adapter has concavo-convex patterns formed in the exposed outer surface thereof.

* * * * *